US009843870B2

(12) United States Patent
Naumann

(10) Patent No.: US 9,843,870 B2
(45) Date of Patent: Dec. 12, 2017

(54) APPARATUS, SYSTEM AND METHOD FOR DRYING OF HEARING AID DEVICES

(71) Applicant: SIVANTOS PTE. LTD., Singapore (SG)

(72) Inventor: Frank Naumann, Bubenreuth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/072,571

(22) Filed: Mar. 17, 2016

(65) Prior Publication Data

US 2016/0277848 A1 Sep. 22, 2016

(30) Foreign Application Priority Data

Mar. 17, 2015 (DE) ..... 10 2015 204 750

(51) Int. Cl.
*H04R 25/00* (2006.01)

(52) U.S. Cl.
CPC ..... *H04R 25/30* (2013.01); *H04R 2225/31* (2013.01); *H04R 2225/33* (2013.01); *H04R 2460/17* (2013.01)

(58) Field of Classification Search
CPC ..... H04R 29/00; H04R 25/00; H04R 25/55; H04R 25/558; H04R 25/60; H04R 25/65
USPC ..... 381/60, 312–331, 380–381
See application file for complete search history.

(56) References Cited

U.S. PATENT DOCUMENTS 6,399,920 B1 * 6/2002 Guinn ..... F26B 9/003 219/386
6,625,900 B1 * 9/2003 Tobias ..... F26B 3/283 219/383
2003/0196687 A1 * 10/2003 Campbell ..... A61L 2/14 134/35
2005/0017673 A1 1/2005 Tsukamoto et al.
2006/0256989 A1 11/2006 Olsen et al.
2009/0074219 A1 3/2009 Klemenz et al.
2009/0296968 A1 * 12/2009 Wu ..... H04R 25/00 381/323
2010/0011613 A1 * 1/2010 Husung ..... F26B 9/003 34/443
2010/0088916 A1 * 4/2010 Romanek ..... F26B 3/283 34/87
2010/0277121 A1 11/2010 Hall et al.
2010/0301803 A1 12/2010 Flemming
2012/0216418 A1 8/2012 Serman et al.
(Continued)

FOREIGN PATENT DOCUMENTS

EP 2037701 A1 3/2009
EP 2259404 A1 12/2010
(Continued)

*Primary Examiner* — Suhan Ni
(74) *Attorney, Agent, or Firm* — Laurence A. Greenberg; Werner H. Stemer; Ralph E. Locher

(57) ABSTRACT

An apparatus for drying a hearing aid and a hearing aid and a system formed by a hearing aid and a charging device. The apparatus has an energy storage device in the hearing aid, an energy transfer unit and a charging controller. The charging controller charges the energy storage device with energy taken in from the energy transfer unit. The apparatus furthermore has a temperature sensor in the hearing aid and the charging controller is designed to control a charging process in such a way that a thermal loss in the apparatus produces a predefinable temperature pattern in the hearing aid.

13 Claims, 3 Drawing Sheets

(56) References Cited

U.S. PATENT DOCUMENTS

| | | | | |
|---|---|---|---|---|
| 2013/0329925 | A1 | 12/2013 | Boguslavskij et al. | |
| 2016/0057547 | A1* | 2/2016 | Burger ..... | H04R 25/00<br>381/315 |

FOREIGN PATENT DOCUMENTS

| | | | |
|---|---|---|---|
| EP | 2493215 | A1 | 8/2012 |
| EP | 2672731 | A1 | 12/2013 |

* cited by examiner

APPARATUS, SYSTEM AND METHOD FOR DRYING OF HEARING AID DEVICES

BACKGROUND OF THE INVENTION

Field of the Invention:

The invention relates to an apparatus for drying a hearing aid, and also a hearing aid, a system consisting of a charging device and a hearing aid and a method for drying a hearing aid according to the invention.

Hearing aids are portable hearing appliances which provide care for persons with hearing impairment. In order to meet the numerous individual needs, different types of hearing aid such as behind-the-ear hearing aids, hearing aids with an external earpiece (RIC: receiver in the canal) and in-the-ear hearing aids, e.g. concha hearing aids or canal hearing aids (ITE, CIC) also are provided. The hearing aids listed by way of example are worn on the outer ear or in the auditory canal. In addition, however, bone-conduction hearing aids, implantable or vibrotactile hearing aids are also available on the market. The damaged hearing is stimulated either mechanically or electrically.

Hearing aids have openings to allow sound to pass from the earpiece of the hearing aid to the ear and into the hearing aid to the microphones. These openings may also be covered with membranes, but, in order to enable a pressure equalization, it is necessary for at least gases and therefore also water vapor to be able to penetrate the hearing aid. Due to the better acoustic characteristics, it may also be desirable to dispense with films of this type.

Due to a temperature drop in the hearing aid, for example between parts of a housing which is in contact with the skin of the wearer and is heated in this way and other areas of the housing which are cooled by the ambient air, condensation occurs inside the hearing aid in the cooler areas of the hearing aid. This effect can be observed particularly in the case of ITE hearing aids, which are exposed to a moist atmosphere at body temperature in the auditory canal, whereas external parts are significantly colder at low air temperature.

In order to ensure the functional capability of the hearing aid and prevent corrosion in the long term, it is necessary to dry the hearing aid internally also. For this purpose, it is known for the hearing aid to be heated in a drying apparatus from outside over a certain time until the moisture on the inside evaporates and diffuses from the housing.

However, the process takes a lengthy time and, as a result, the moisture may initially be deposited from the heated housing onto cooler internal components.

In EP 2 493 215 A1, an arrangement is described for drying a hearing aid, with a heating unit which heats and thereby dries the hearing aid from outside. The drying process takes place depending on a measurement of a moisture sensor.

In EP 2 037 701 A1, a hearing aid with an electric heating device is described. In one design, a receiver coil which is also used for inductive energy transfer serves as a heating device.

BRIEF SUMMARY OF THE INVENTION

One object of the present invention is therefore to provide a hearing aid and system with a charging device, and also a method which improves the drying of the hearing aid.

According to the invention, this object is achieved by an apparatus as claimed and a hearing aid as claimed, a system consisting of a hearing aid, an apparatus and a charging device as claimed and the method according to the invention as claimed.

The apparatus according to the invention for drying a hearing aid has an energy store in or for arrangement in the hearing aid, an energy transfer unit and a charging controller. The energy transfer unit is also referred to as a charging apparatus. It is conceivable for the charging controller similarly to be located in the hearing aid, or to be designed as a component of a further unit, for example a charging point or a charging cradle. The charging controller is designed to charge the energy store by means of energy taken in from the energy transfer unit. For example, the charging controller may be provided in the hearing aid and may provide a charging current for a chargeable battery of the hearing aid as an energy store via a cable or via an induction coil as an energy transfer unit. The charging current is controlled by the charging controller. However, it is also conceivable for the charging controller to be provided in a different unit and to influence the charging current by means of the transferred energy.

The apparatus furthermore has a temperature sensor in or for arrangement in the hearing aid by means of which a temperature in the hearing aid is measured. The charging controller is designed to regulate a charging process depending on the temperature in such a way that a thermal loss in the apparatus produces a predefinable and preferably predefined temperature profile in the hearing aid. For example, the battery is heated due to the thermal loss during charging so that the charging controller can achieve a predefined temperature of the battery via the charging current depending on the measured temperature during the charging process.

Since the charging controller generates a temperature profile inside the hearing aid via the thermal loss, the hearing aid can advantageously be dried from the inside out and damage to the hearing aid due to the high temperatures can simultaneously be avoided.

One advantage achieved with the invention consists, in particular, in that a component which generates heat, particularly during a charging process, is disposed within the hearing aid. This component is, for example, the energy store, the energy transfer unit, the charging controller or a combination thereof. One component which is disposed within the hearing aid is preferably used exclusively for drying, as a result of which the drying is then particularly effective.

The quantity of heat that is generated by the heating element is optimally set by a control. To do this, a temperature in the hearing aid is measured by means of the temperature sensor and is used as a measured quantity for the control. The temperature is also referred to as the internal temperature of the hearing aid. The temperature is dependent on the thermal loss which in turn is dependent on the charging process. The energy transfer to the hearing aid is ultimately controlled in fact by a suitable controller of the energy transfer unit. The generated thermal loss which is used as heating energy to dry the hearing aid is thereby indirectly influenced.

Due to the control, the temperature on the whole then follows the predefined temperature profile which is optimum for the drying. An unwanted overheating and damage to the components of the hearing aid are advantageously avoided by means of the control. For this purpose, the temperature profile has, in particular, a maximum temperature and the charging process is controlled in such a way that the measured temperature corresponds at most to the maximum temperature and preferably lies below it. The maximum temperature is preferably at most 45° C.

The fact that the charging process is controlled for a drying depending on a required temperature profile and not, for example, (exclusively) on the basis of electric power variables of the components can therefore be regarded as an essential aspect.

A hearing aid according to the invention has an apparatus according to the invention for drying and also a housing with an opening that is permeable to water vapor. The hearing aid shares the advantages of the apparatus according to the invention.

A system according to the invention has a hearing aid, an apparatus according to the invention and a charging device, and also an information transfer means with a data transfer device for transmitting or for transmitting and receiving in the hearing aid and a data transfer device for receiving or for transmitting and receiving in the charging device. The data transfer devices are designed to transfer a measured value of a temperature sensor from the hearing aid. The charging device furthermore has an energy transmitting unit and the hearing aid has an energy receiving unit. The charging controller is designed to set the power emitted by the energy transmitting unit depending on the transferred measured value and control it depending on the temperature.

The system according to the invention can advantageously already control and generally adapt the power transferred to the hearing aid according to the temperature in the hearing aid so that the power consumption is minimized and the circuit in the hearing aid can be simplified and, in particular, components with greater power and space requirement can be dispensed with.

The method according to the invention for drying a hearing aid is carried out by means of an apparatus, in particular an apparatus as described above. The apparatus has an energy store, an energy transfer unit, a charging controller and a temperature sensor in the hearing aid. A temperature in the hearing aid is measured by means of the temperature sensor. The charging controller charges the energy store by means of energy taken in from the energy transfer unit, wherein the charging controller controls a charging process depending on the temperature in such a way that a thermal loss in the apparatus generates a predefinable temperature profile in the hearing aid.

The method according to the invention also shares the advantages of the apparatus according to the invention. Further advantageous developments of the invention are indicated in the dependent claims.

In one suitable embodiment of the apparatus according to the invention, said apparatus is designed to generate the thermal loss in the energy store during the charging process. As a result, the hearing aid is advantageously charged and dried simultaneously. The energy store is, in particular, a battery or an accumulator.

The battery is heated during the charging process depending on the state of charge and the supplied charging current. The heat generated during the charging can thus be advantageously used to dry the hearing aid in a controlled manner. Due to its relative size, the battery is also capable of heating the hearing aid quickly and evenly. The control of the charging process advantageously prevents an overheating of the hearing aid.

In one conceivable embodiment, the apparatus according to the invention is designed to generate the thermal loss in the charging controller during the charging process. The energy transfer unit preferably has a coil for inductive energy transfer, wherein the coil then serves as a heating element and generates the thermal loss. The coil is disposed either in the hearing aid or in a charging point. An energy transfer unit is typically used with a coil pair, with one coil in the hearing aid and the other in the charging point. The coil in the hearing aid is appropriately used primarily or exclusively, since it advantageously dries the hearing aid from the inside out. The coil in the charging point does not then need to generate any thermal loss.

If heat is generated in the energy transfer unit, the hearing aid can also be dried in an advantageous manner if the battery is already charged, without damaging the battery. Thermal loss within the meaning of the invention is also to be understood as heat arising from a resistor or active component as resistive loss when heat flows through.

In one possible embodiment of the apparatus according to the invention, the charge controller has an information transfer means which is designed to transfer a measured value of the temperature sensor from the hearing aid, i.e. a temperature, namely an internal temperature of the hearing aid. The transfer can be effected, for example, as a signal via a connection line, but also wirelessly via electromagnetic waves or acoustic signals. The charging controller is designed to pick up the measured value and set a power transferred by the energy transfer unit depending on the measured value. The power is controlled depending on the temperature.

The information transfer means advantageously enables the measuring sensor, i.e. the temperature sensor, to be disposed in the hearing aid, whereas the control and power electronics are located outside, so that the hearing aid can be designed as simple and as small as possible. For this purpose, it is conceivable for the information transfer means to have a data transfer device in the hearing aid and a data transfer device outside the hearing aid.

In one conceivable embodiment of the apparatus according to the invention, the energy transfer unit transfers the energy and/or the data transfer units transfer a measured value of the temperature sensor wirelessly by means of electric and/or magnetic fields.

A wireless transmission advantageously enables a hearing aid with a housing which has no additional openings for connectors, so that the housing can be smaller and also more effectively sealed against moisture and dirt.

The characteristics, features and advantages of this invention described above and the manner in which they are achieved will become clearer and more readily understandable in conjunction with the following description of the example embodiments which are explained in detail with reference to the drawings.

DESCRIPTION OF THE INVENTION

Figure 1:
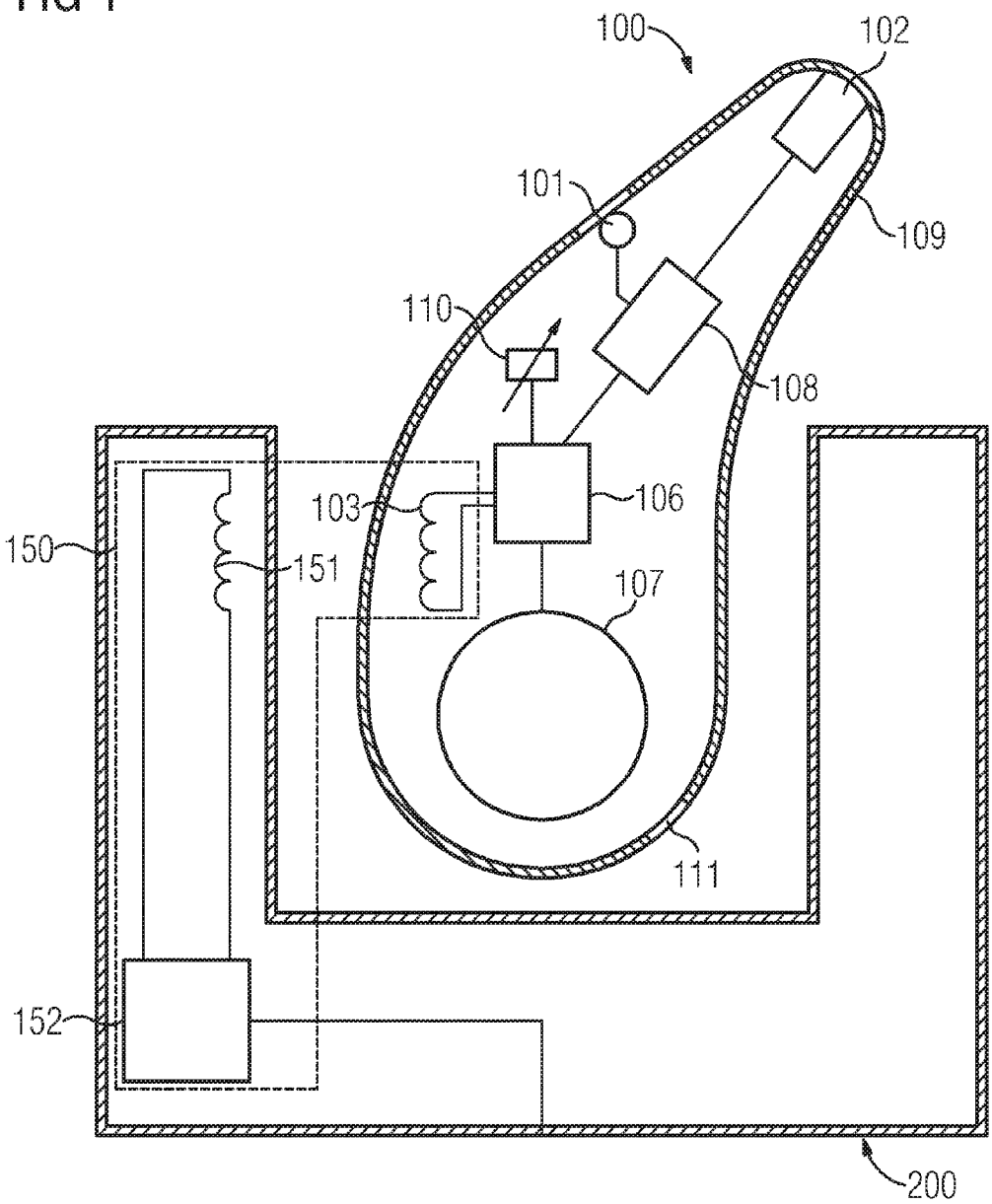
FIG. 1 shows an example of a schematic representation of a system according to the invention, a hearing aid according to the invention and an apparatus according to the invention.

FIG. 1 shows the basic structure of a hearing aid 100 according to the invention. One or more acoustoelectric transducers 101 are disposed in a hearing aid housing 109 to absorb the sound or acoustic signals from the environment. The acoustoelectric transducer 101 is, for example, a microphone for converting the sound into an electrical input signal.

A signal processing device 108 which is similarly integrated into the hearing aid housing 109 processes the first electrical signals and has a signal connection to the microphone for this purpose. The output signal of the signal processing device 108 is transmitted to a loudspeaker or earpiece 102 which outputs an acoustic signal. Where appropriate, the sound is transmitted to the eardrum of the device wearer via a sound tube that is positioned with an earmold in the auditory canal. As well as electroacoustic transducers, other electromechanical transducers, such as, for example bone-conduction transducers, are also conceivable. As well as the behind-the-ear design shown, the hearing aid 100 according to the invention may also be an in-the-ear or in-the-canal hearing aid.

The energy supply of the hearing aid 100 and, in particular, that of the signal processing device 108 is provided by a battery 107 similarly integrated into the hearing aid housing 109 as an energy store. The battery 107 is rechargeable and is electrically connected to a charging controller 106. The charging controller 106 is in turn electrically connected to an energy-receiving apparatus 103, which is shown in FIG. 1 as an induction coil. Depending on the design of the system according to the invention, it is conceivable for the charging controller 106 to perform functions such as rectification and voltage conversion for the battery 107 and for the signal processing device 108. As well as the induction coil shown, antennas or photovoltaic cells similar to a solar cell are conceivable as the energy-receiving apparatus 103, depending on the frequency of an electromagnetic alternating field that is used. A resistive connection to an external energy source is also possible.

The energy-receiving apparatus 103 is part of an energy transfer unit 150 which consists of the energy-receiving apparatus 103 in the hearing aid 100 and an energy-transmitting device 151, 152. The energy-transmitting device 151, 152 may, for example, be part of a charging device or a charging cradle 200, generally a charging point. In the embodiment shown in FIG. 1, the energy-receiving apparatus 103 and the energy-transmitting device 151 are designed in each case as an induction coil, wherein the transmitting induction coil is fed by an alternating-current generator 152 and an electromagnetic alternating field is generated which the energy-receiving apparatus 103 picks up and feeds to the charging controller 106 as an alternating current. However, it is also conceivable for the energy-transmitting apparatus 151 to be a light source and for the energy-receiving device 103 to be a photovoltaic cell. In the simplest case, a resistive connection for feeding the energy is also conceivable, e.g. via contacts on the hearing aid 100 and on the charging device 200.

The charging controller 106 controls the power taken in from the energy-receiving device 103 and fed as a charging current to the battery 107 depending on a measured value recorded by a temperature sensor 110 for a temperature inside the hearing aid 100 in such a way that the temperature follows a predefined variation with time. To do this, it is conceivable for the charging controller to have a processor with a stored temperature curve which, for control purposes, compares the stored reference value of the temperature curve with an actual value measured by the temperature sensor 110, and then, as a final control element, to control the charging current for the battery 107.

The hearing aid 100 according to the invention furthermore has an opening 111 in the housing 109 through which moisture can escape. The opening 111 is preferably covered with a semipermeable membrane or other means which allows water vapor to escape but does not allow water to penetrate in condensed form.

Figure 2:
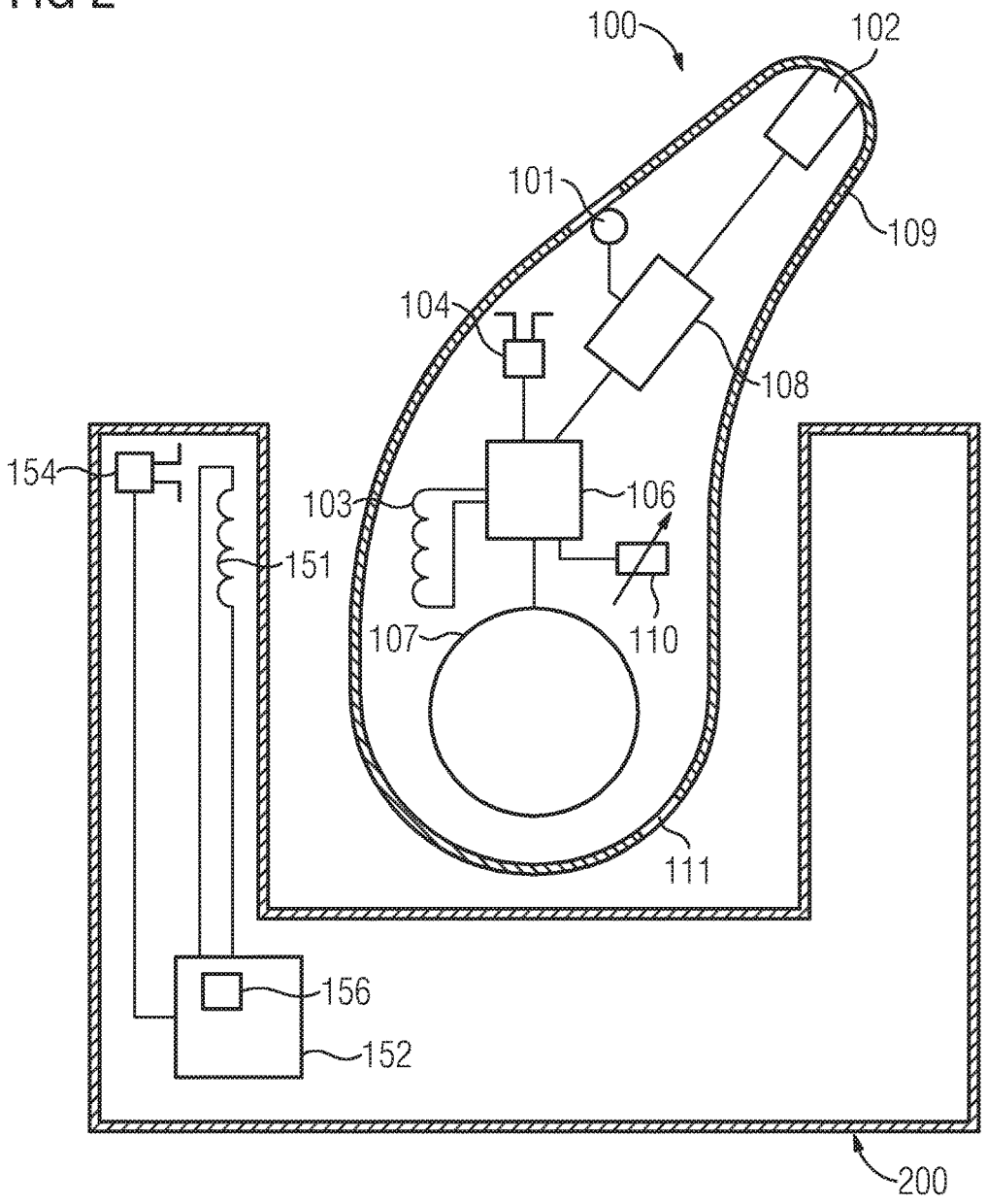
FIG. 2 shows a further example of a schematic representation of a system according to the invention, a hearing aid according to the invention and an apparatus according to the invention.

A further conceivable design of the apparatus according to the invention can be seen in FIG. 2. The same elements are denoted with the same reference numbers in FIG. 2.

The hearing aid 100 shown in FIG. 2 furthermore has a data transfer means 104 for transmitting or for transmitting and receiving data. The data transfer device 104 of the hearing aid is designed to transmit measurement data of the temperature sensor 110. In addition, it is also conceivable for the data transfer device 104 to transmit digital audio signals or program data for the signal processing 108. It is conceivable for the data transfer device 104 to use, for example, the Bluetooth standard for transmission. However, it is similarly also conceivable for an induction coil to be provided instead of an antenna, depending on the frequency range. It is also conceivable to use the antenna or induction coil jointly for energy transfer and for data transfer, for example by modulating an electromagnetic alternating field with encoded data. Finally, a data transfer via audible tones or a resistive connection is also conceivable.

The charging device of the apparatus shown in FIG. 2 has a data transfer device 154 which complements the data transfer device 104 of the hearing aid, so that the charging device 200 can receive data transmitted by the hearing aid 100 via the data transfer device 104. The received measured values for the temperature in the hearing aid 100 are fed to the alternating current generator 152 which has a controller 156 which sets the power of the generated alternating current in such a way that the predefined temperature pattern in the hearing aid is achieved by the charging of the battery with the transferred power. For this purpose, as described in FIG. 1, the actual temperature value of the temperature sensor 110 is compared with a stored reference value by the controller 156 of the alternating current generator 152 and the alternating current is set accordingly as a final control element.

According to the invention, the power of a light source as the energy-transmitting apparatus 151 or a current can also be set accordingly via a resistive connection.

It is also conceivable for the charging controller 106 to be integrated in the charging device 200 and, for example, for only a rectification of the received alternating current to be carried out in the hearing aid 100.

Figure 3:
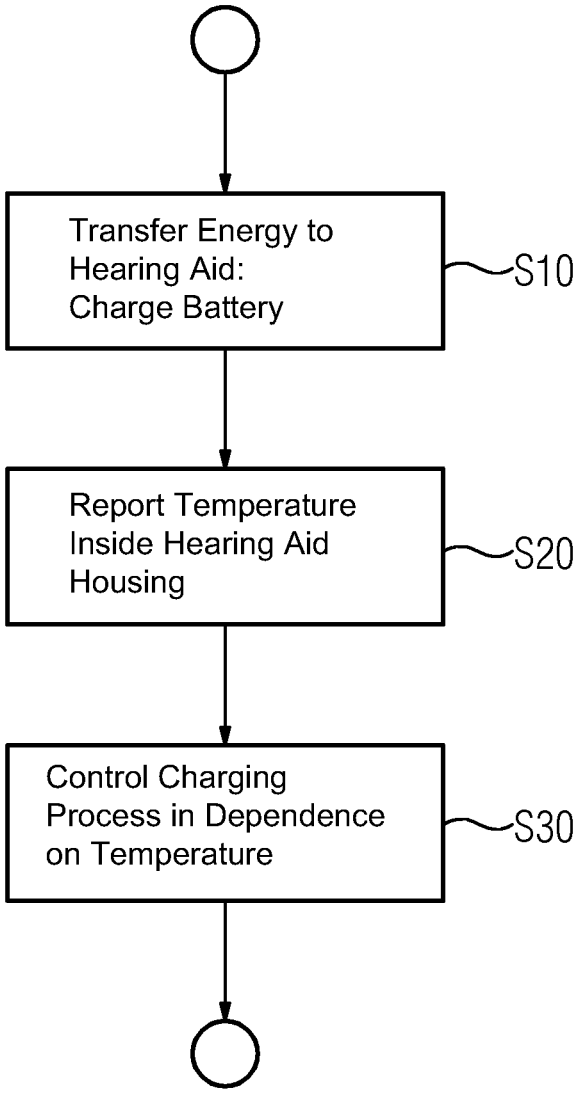
FIG. 3 shows an example of a schematic representation of a sequence of a method according to the invention.

FIG. 3 shows a schematic flow diagram of a method according to the invention. The method according to the invention is carried out, for example, by means of the apparatuses and systems shown in FIG. 1 and FIG. 2.

In a step S10 of the method according to the invention, energy is transferred to the hearing aid 100 by means of the energy transfer unit 150 in order to charge the battery 107. Depending on the design of the hearing aid 100 according to the invention, the energy is forwarded via a charging controller 106 to the battery 107 or is fed directly, for example via a rectifier of the battery 107.

In a step S20, the charging controller 106 receives a measured value measured by the temperature sensor 110, indicating a temperature inside the hearing aid housing 109. It is also conceivable for the charging controller 106 to be similarly disposed in the housing 109 of the hearing aid, and to have a direct signal connection via an electrical line to the temperature sensor 109. However, it is similarly conceivable for the measured value to be transmitted via data transfer devices 104, 154, for example wirelessly, and for the charging controller 106 not to be disposed in the housing 109.

In a step S30, the charging controller 106, 156 compares the measured value for the temperature with a predefined value for the temperature. The predefined value may, for example, be stored as a temperature pattern in the form of a table or by means of a calculation rule in a memory. The memory may be part of the charging controller 106, 156, or may be external.

In a step S30, the charging controller 106, 156 controls a charging process depending on a measured value measured by the temperature sensor in such a way that a thermal loss in the apparatus produces a predefined temperature pattern in the hearing aid 100. If, for example, the temperature measured by the temperature sensor 110 is lower than the predefined temperature, the charging controller 106; 156 increases the power fed to the battery 107 as the charging current so that, due to an increasing thermal loss, the temperature of the battery 107 and/or of the charging controller 106 the temperature in the housing 109 of the hearing aid also rises. Conversely, if the temperature measured by the temperature sensor 110 is higher than the predefined temperature, the charging controller decreases the power fed to the battery 107 so that, also due to a decreasing thermal loss, the temperature of the battery 107 and/or of the charging controller 106 the temperature in the housing 109 of the hearing aid falls. The power is thus controlled depending on the measured temperature.

Steps S10 to S30 of the method according to the invention are preferably repeated until a predefined temperature pattern has been completed.

Although the invention has been illustrated and described in greater detail by means of the preferred example embodiment, the invention is not limited by the disclosed examples and other variations may be derived herefrom by the person skilled in the art without departing from the protective scope of the invention.

The invention claimed is:

1. An apparatus for drying a hearing aid, the apparatus comprising:
- an energy storage device in the hearing aid;
- an energy transfer unit;
- a charging controller configured to charge said energy storage device with energy taken in from said energy transfer unit;
- a temperature sensor connected to said charging controller and disposed for measuring a temperature in the hearing aid;
- said charging controller being configured to closed-loop control a charging process depending on the temperature such that a thermal loss in the apparatus generates a predefinable temperature profile in the hearing aid to thereby dry the hearing aid with heat produced inside the hearing aid.

2. The apparatus according to claim 1, wherein the thermal loss is produced in the energy storage device during the charging process.

3. The apparatus according to claim 1, wherein the thermal loss is produced in the charging controller during the charging process.

4. The apparatus according to claim 1, which further comprises an information transfer device configured for transferring a measured value of said temperature sensor from the hearing aid and wherein said charging controller is configured to receive the measured value and to set a power transferred by said energy transfer unit.

5. The apparatus according to claim 4, wherein one or both of said energy transfer unit and said information transfer device are configured to transfer wirelessly.

6. The apparatus according to claim 5, wherein said one or both of said energy transfer unit and said information transfer device are configured to transfer wirelessly by way an electric field and/or a magnetic field.

7. A combination, comprising an apparatus according to claim 1 and a hearing aid with a hearing aid housing formed with at least one opening permeable to water vapor.

8. The apparatus according to claim 1, wherein said charging controller comprises a processor with a stored temperature curve.

9. The apparatus according to claim 1, wherein the temperature pattern is in the form of a table or by means of a calculation rule.

10. A hearing aid system, comprising:
- a hearing aid having an energy-receiving device;
- a charging device having an energy-transmitting apparatus; and
- an apparatus for drying said hearing aid, the apparatus including:
  - an energy storage device in said hearing aid;
  - an energy transfer unit;
  - a charging controller configured to charge said energy storage device with energy taken in from said energy transfer unit;
  - a temperature sensor connected to said charging controller and disposed for measuring a temperature in said hearing aid;
  - an information transfer device configured for transferring a measured value of said temperature sensor from said hearing aid, said information transfer device having a data transfer device in said hearing aid and a data transfer device in said charging device;
  - said charging controller being configured to receive the measured value and to set a power output by said energy-transmitting apparatus of said charging device depending on the transmitted measured value so that a thermal loss in the apparatus generates a predefinable temperature profile in said hearing aid and said hearing aid is dried with heat produced inside said hearing aid.

11. The system according to claim 10, wherein one or both of said energy transfer unit and said data transfer device are configured to transfer wirelessly.

12. The system according to claim 10, wherein said one or both of said energy transfer unit and said information transfer device are configured to transfer wirelessly by way an electric field and/or a magnetic field.

13. A method for drying a hearing aid, the method comprising:
- providing an apparatus with an energy storage device, an energy transfer unit, a charging controller and a temperature sensor in the hearing aid;
- measuring a temperature in the hearing aid with the temperature sensor;
- charging the energy storage device by the charging controller with energy taken in from the energy transfer unit; and
- controlling the charging process with the charging controller in dependence on the temperature such that a thermal loss in the apparatus produces a predefinable temperature pattern in the hearing aid to thereby dry the hearing aid with heat produced inside the hearing aid.

* * * * *